US010596830B1

(12) United States Patent
Veres et al.

(10) Patent No.: US 10,596,830 B1
(45) Date of Patent: Mar. 24, 2020

(54) SUBSTRATE PACKAGE HAVING VARIABLE MARKING

(71) Applicant: Palo Alto Research Center Incorporated, Palo Alto, CA (US)

(72) Inventors: Janos Veres, San Jose, CA (US); Antonio St. Clair Lloyd Williams, Concord, CA (US); Marc E. Mosko, Santa Cruz, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 16/147,247

(22) Filed: Sep. 28, 2018

(51) Int. Cl.
*B41J 3/407* (2006.01)
*B65H 29/00* (2006.01)
*B65H 37/00* (2006.01)

(52) U.S. Cl.
CPC ..... *B41J 3/4073* (2013.01); *B65H 29/00* (2013.01); *B65H 37/00* (2013.01)

(58) Field of Classification Search
CPC ..... B41J 3/4073; B65H 29/00; B65H 37/00
See application file for complete search history.

(56) References Cited

U.S. PATENT DOCUMENTS 5,085,417 A * 2/1992 Copham ..... B41F 13/54 270/1.02
5,196,868 A * 3/1993 No ..... B41J 29/46 271/145
5,243,394 A * 9/1993 Matsuno ..... G03G 15/6552 347/2
5,717,976 A * 2/1998 Chowdry ..... B65H 43/00 270/58.01
6,099,178 A 8/2000 Spurr et al.
6,585,163 B1 * 7/2003 Meunier ..... G06K 19/06028 235/385
6,634,814 B2 10/2003 Spurr et al.
6,637,666 B2 * 10/2003 Meunier ..... G06K 19/06028 235/494
7,267,498 B2 * 9/2007 Cahill ..... B41J 3/60 101/483
7,314,216 B2 * 1/2008 Meunier ..... G06K 1/121 270/1.02
7,789,310 B2 * 9/2010 Butikofer ..... G03G 15/6511 235/375
7,885,597 B2 * 2/2011 Gast ..... H04N 1/00567 271/162

(Continued)

FOREIGN PATENT DOCUMENTS

EP 1714791 A2 10/2006
JP 2000281268 A 10/2000

*Primary Examiner* — Huan H Tran
(74) *Attorney, Agent, or Firm* — Womble Bond Dickinson (US) LLP; Daniel E. Ovanezian

(57) ABSTRACT

Disclosed are a substrate package, a method of fabricating the substrate package, and a system including the substrate package. The substrate package includes a stack of substrate sheets in an individual form, a continuous form, or a roll form. The stack has a sidewall defined by edges of the substrate sheets and a mark on the sidewall includes mark segments on respective edges. The mark segments vary such that one or more of the mark segments have a respective segment characteristic, such as a length. The segment characteristic can encode information about an attribute of the substrate sheet, such as a physical characteristic of the sheet.

19 Claims, 8 Drawing Sheets

(56) References Cited

U.S. PATENT DOCUMENTS

| | | | | |
|---|---|---|---|---|
| 8,915,187 | B2 * | 12/2014 | Horn | G03G 15/00 101/485 |
| 2006/0066654 | A1 * | 3/2006 | Chelvayohan | B41J 29/38 347/16 |

* cited by examiner

SUBSTRATE PACKAGE HAVING VARIABLE MARKING

TECHNICAL FIELD

Implementations of the present disclosure relate to substrate packages having stacked substrate sheets.

BACKGROUND

Media sheets are used in various printing applications, such as the printing of newspapers, books, metal foils, agricultural media, and the like. Media sheets are stacked in a form suitable for a particular printing process, such as a roll form, a folded continuous sheet form, or a stacked sheet form. A printer prints on the sheets in a printing process. Parameters of the printing process can depend on the type of media sheets, and accordingly, a user can enter the parameters into the printer to control the printing process.

Some printers are adapted to automatically determine printing parameters based on batch level information derived from a media supply holder. For example, the printer can obtain the batch level information corresponding to every media sheet in the batch when the media sheets are loaded for printing. Respective communication devices of the printer and the media supply holder, e.g., a spool, may communicate the batch level information. Alternatively, a reader of the printer can read a barcode on the media supply holder to obtain the batch level information. In either case, the batch level information may be information about a type of the media sheets in the batch, which the printer can use to adjust the printing parameters for the entire batch of media sheets.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

Figure 1:
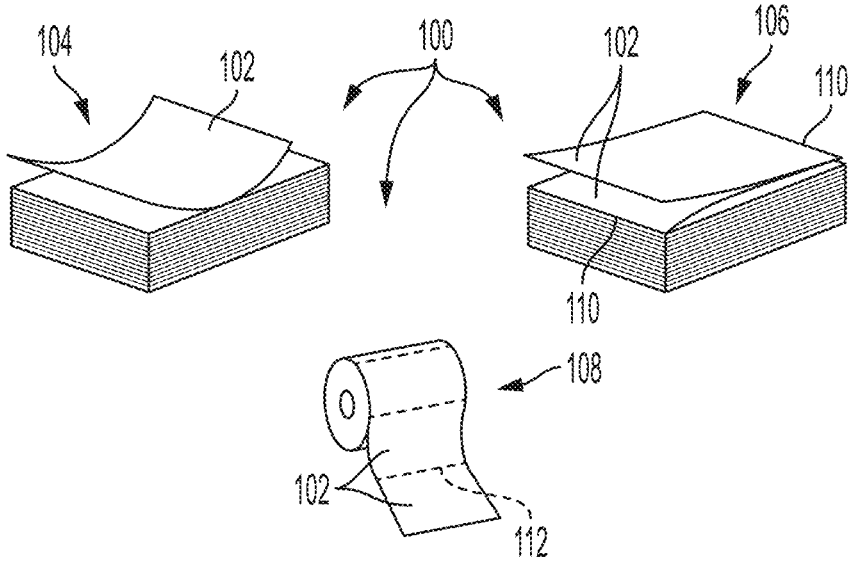
FIG. 1 is a pictorial view of substrate packages, in accordance with some embodiments of the present disclosure.

Existing methods of obtaining batch level information from a media supply holder involves identifying information about all media sheets on the holder. For example, a barcode on a spool may indicate a media type of all of the sheets on the spool. The batch level information is not specific to an individual sheet, and thus, does not allow the printer to adjust printing parameters on a sheet-by-sheet basis.

A substrate package, a method of fabricating the substrate package, and a system including the substrate package, are described. The substrate package can be a substrate package having a variable marking. The variable marking can include one or more marks on the substrate package that vary such that a segment of the mark encodes information about a substrate sheet that contains the segment. More particularly, in an embodiment, the substrate package includes a stack of one or more substrate sheets that has a sidewall that is marked with the variable marking. For example, the variable marking can be applied to the sidewall of the bulk substrate package in a single marking operation. The variable marking can include one or more variable marks. The variable marks on the sidewall includes mark segments that vary along a mark axis. The variable mark segments can vary on a sheet-by-sheet basis. The mark segments can encode information about the individual sheets. For example, each mark segment can have a respective segment characteristic, e.g., a respective length, which corresponds to an attribute of the particular sheet that has the mark segment, e.g., a physical characteristic of the sheet. Accordingly, each sheet can be uniquely marked to encode information about the sheet that a printer can use to adjust printing parameters on a sheet-by-sheet basis.

It will be appreciated that the term "variable," as it relates to the marking of the substrate package as described below, differentiates the substrate package from existing batch level markings that do not provide information about the individual sheets in the batch. For example, existing labels printed on a side of a batch of sheets, such that the label is visible from the side, may not provide sheet level information about the sheets in the batch. By contrast, the variable marking described below can be applied to the bulk substrate package, and can provide sheet level information about individual sheets in the package. Similarly, the term "variable," as it related to the marking of the substrate package as described below, differentiates the substrate package from existing sheet level marks that do not provide information about the individual sheets in relation to the batch. For example, existing marks on individual sheets in a batch may be visible from the side when the sheets are stacked, but the marks may not provide sheet level information about the sheets in relation to the batch, e.g., a position in the batch. By contrast, the variable marking described below can be applied to the bulk substrate package, and can provide sheet level information about the sheets in relation to the batch.

According to embodiments illustrated herein, there is provided a substrate package including a stack of several substrate sheets having respective edges. The stack has a sidewall defined by the edges. A mark is located on the sidewall. The mark includes several mark segments on the edges and along a mark axis. Segment characteristics of the mark segments vary along the mark axis such that a mark segment on an edge of a substrate sheet has a segment characteristic specific to an attribute of the substrate sheet.

According to embodiments illustrated herein, there is provided a method of fabricating the substrate package. The method includes stacking one or more substrate sheets having respective edges into a stack having a sidewall defined by the edges. The method includes applying a mark on the sidewall. The mark includes several mark segments on the edges and along a mark axis. Segment characteristics of the mark segments vary along the mark axis such that a mark segment on an edge of a substrate sheet has a segment characteristic specific to an attribute of the substrate sheet.

According to embodiments illustrated herein, there is provided a system including the substrate package described above, and a printer. The printer includes an optical reader to detect the segment characteristic, and one or more processors configured to determine, based on the segment characteristic, the attribute of the substrate sheet.

The package embodiments described below can include a stack of substrate sheets. For example, the substrate package can be a media package having a stack of media sheets for use in a printing application. However, the substrate package can include other substrates, such as plastic substrates, metal foils, barrier films, agricultural media, donor films, dye transfer and thermal transfer media, paper carton, wooden panels, wooden laminates, or ceramic substrates, to name only a few alternative substrates. Similarly, the substrates can be used in alternative applications, such as an appliance manufacturing process or a building material manufacturing process, to name only a few alternative applications.

Referring to FIG. 1, a pictorial view of substrate packages is shown in accordance with an embodiment. A substrate package can include one or more sheets of substrate material. The substrate sheets can include engineering or constructions materials. For example, the substrate sheets can include one or more of a tile sheet, a wood sheet, a metal sheet, a glass sheet, or a plastic sheet. In an aspect, the substrate package is a media package 100. In such case, the substrate sheets can be media sheets 102, e.g., sheets of material for carrying information. Accordingly, the substrate package can include one or more media sheets 102, such as paper sheets, thermal transfer media, or another media substrate for use in a printing process. Throughout this description, the substrate package is described in terms of media package 100 and substrate sheets are described in terms of media sheets 102. It will be appreciated, however, that the description can apply to other substrate packages and substrate sheets having non-media materials and/or purposes, as described above.

In an embodiment, media sheets 102 are arranged in a stack in one of several different formats, such as an individual form 104, a continuous form 106, or a roll form 108. Media package 100 having individual form 104 includes several media sheets 102 independently stacked on each other. Media package 100 having continuous form 106 includes several media sheets 102 forming portions of a continuous sheet that is folded and stacked on itself. For example, continuous form 106 can include a continuous sheet that includes one or more of a plastic foil, a metal foil, a film, a fabric, or a membrane arranged into a multilayer stack by folding the continuous sheet on itself. Media package 100 having roll form 108 includes several media sheets 102 joined to each other along reference joints 112 and mounted on a mounting core, such as a cardboard tube. For example, roll form 108 can include a continuous sheet that includes one or more of a plastic foil, a metal foil, a film, a fabric, or a membrane arranged into a multilayer stack by winding the continuous sheet around a mounting core.

The portions of the continuous sheet, whether in continuous form 106 or roll form 108, may be physically delineated. For example, folds 110 can distinguish portions of the continuous sheet in continuous form 106. Similarly, reference joints 112, which can be perforations, seams, etc., may distinguish portions of the continuous sheet in roll form 108. The portions may, however, be delineated by reference only. For example, reference joints 112 may be reference geometry that does not physically distinguish the portions when the continuous sheet is wound on the mounting core. Rather, the entire continuous sheet may be monolithic. When the continuous sheet is dispensed in a printing operation, however, the portions can be printed on and cut. The cut portions form respective media sheets 102 at the time that the sheets are cut. Thus, although the portions may be indistinguishable from each other when mounted on the mounting core prior to the printing operations, the portions may nonetheless be defined in relation to their severance at the time of printing.

Figure 2:
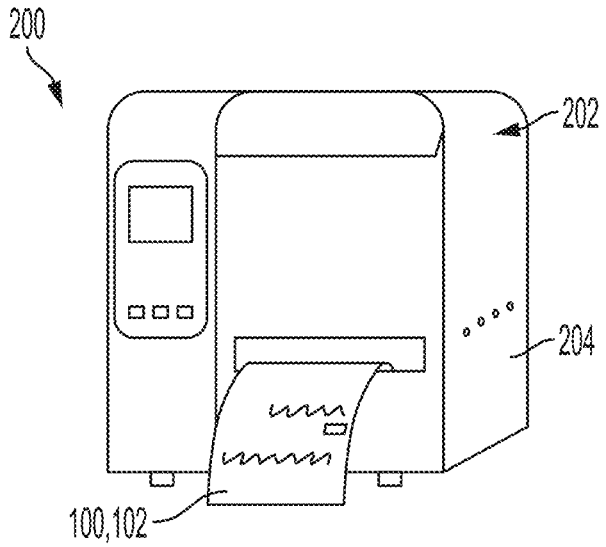
FIG. 2 is a pictorial view of a system including a printer and a media package, in accordance with some embodiments of the present disclosure.

Referring to FIG. 2, a pictorial view of a system including a printer and a media package is shown in accordance with an embodiment. Media packages structured and fabricated as described below can be used in numerous manufacturing processes. For example, any of the media package formats can be used to print newspapers, bank statements, music sheets, plastic or metal foils, protective sheets, barrier films, agricultural media, donor films, or the like. Roll form media packages can be used in roll-to-roll printing processes to fabricate printed electronics. Individual form media packages or continuous form media packages can be used in sheet-fed printing processes to manufacture tiles or glass sheets, or sheet-fed manufacturing processes to manufacture components in the automotive, aeronautics, or building industries.

In an embodiment, a system 200, which is usable to print information on media sheets 102 of media packages 100, includes a printer 202. The word "printer" as used herein encompasses any apparatus, such as a digital copier, bookmaking machine, facsimile machine, multi-function machine, and the like, which performs a print outputting function for any purpose. Media package 100 having encoded media sheets 102, as described below, can be loaded into printer 202 to perform a printing process. More particularly, printer 202 can include an optical reader, e.g., photosensor or a camera, mounted inside of a printer housing 204. The optical reader can capture images, e.g., reflective or transmissive images, of edges and/or faces of media sheets 102. The optical reader can detect characteristics of mark segments captured in the images. Furthermore, printer 202 can include one or more processors mounted inside of printer housing 204. The one or more processors may be configured to determine, based on the detected characteristic, an attribute of media sheet 102 having the mark segment 312. The one or more processors may be configured to set a printing parameter of printer 202 based on the attribute of media sheet 102. In an embodiment, the one or more processors can use the information encoded in the mark segments for other purposes, such as to authenticate media package 100 or calibrate printer components.

Figure 3:
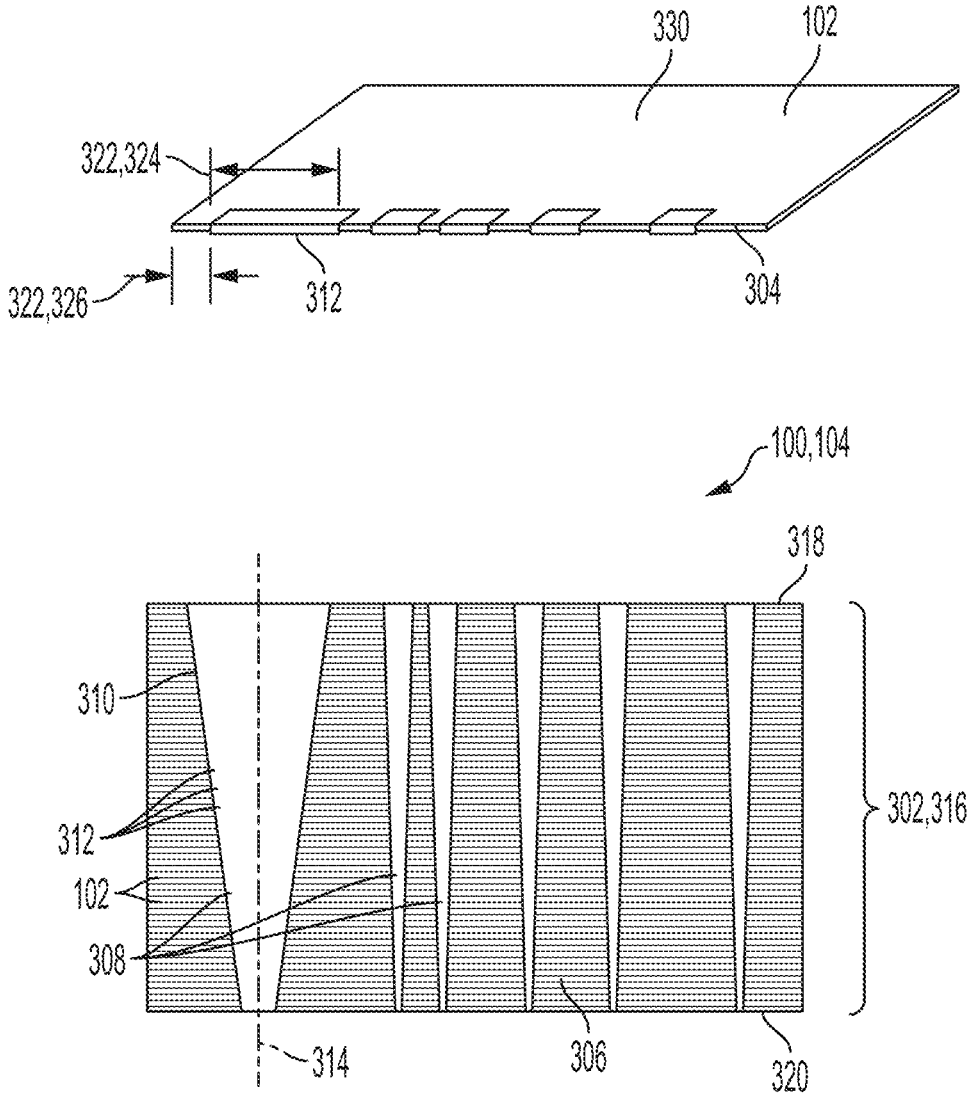
FIG. 3 is a side view of a media package having an individual form, in accordance with some embodiments of the present disclosure

Referring to FIG. 3, a side view of a media package having an individual form is shown in accordance with an embodiment. Media package 100 having individual form 104 includes a stack 302 of one or more media sheets 102 having respective edges 304. The individual media sheets 102 of media package 100 can be arranged in stack 302. For example, the media sheets 102 can be layered on each other face-to-face to form stack 302 having a sidewall 306 facing laterally outward. More particularly, a combination of the edges 304 of media sheets 102 define sidewall 306. Accordingly, media sheets 102 have a same number of corners as media package 100 has sidewalls.

In an embodiment, a marking 308 is applied to the bulk stack. Marking 308 can be a variable marking applied on sidewall 306 in one or more marking operations, e.g., in a single marking operation. For example, the marking operation(s) can include a stamping, printing, or heating operation, which apply the variable marking in bulk, as described below. The marking operation(s) can apply marking 308 having one or more marks 310 on sidewall 306. In an embodiment, marking 308 has several marks 310 on sidewall 306. Accordingly, marking 308 can be applied to the bulk stack 302, however, each mark 310 of marking 308 can traverse several edges 304 of individual media sheets 102. Thus, portions of each mark 310 can be read out serially on sequential sheets in the stack 302.

The portions of each mark 310 on adjacent media sheets 102 are mark segments 312. More particularly, each mark 310 on sidewall 306 includes several mark segments 312. Mark segments 312 can be distributed along a mark axis 314 on adjacent edges 304. For example, each mark segment 312 can have a width in a horizontal direction intersecting and/or orthogonal to a direction of mark axis 314. The widths of each mark segment 312 can overlap visually such that mark 310 appears as a continuous mark of marking 308. In an embodiment, marking 308 includes several continuous marks 310. For example, the continuous marks depicted in FIG. 3 have a visual appearance of vertical lines on sidewall 306 having respective line widths tapering from top sheet 318 to bottom sheet 320. By contrast, marking 308 can include one or more discontinuous marks 310 having mark segments 312 that do not overlap visually, e.g., a rightward end of a first mark segment may be to the left of a leftward end of a second mark segment. Accordingly, the marks 310 of marking 308 may be continuous or discontinuous.

Sidewall 306 may have a thickness 316 defined between top sheet 318 and bottom sheet 320 of stack 302. In an embodiment, each mark 310 of marking 308 extends along at least a portion of thickness 316. For example, one or more marks 310 can extend substantially across thickness 316, e.g., over at least half of the thickness of sidewall 306. As depicted in FIG. 3, at least one mark 310 of marking 308 extends entirely across sidewall 306 from top sheet 318 to bottom sheet 320, and thus, mark 310 can have a length along mark axis 314 (or the length can have a vertical component) equal to thickness 316. Mark 310 can vary along mark axis 314, e.g., a width, ink density, color, etc., can change along the length of mark 310.

Mark segment 312 can have one or more segment characteristics 322. Segment characteristic 322 may include a length 324 of mark segment 312 along edge 304. Length 324 of mark segment 312 can define the width of mark 310 at the level in stack 302 where mark segment 312 is located. Segment characteristic 322 may include a color of mark segment 312. The color of mark segment 312 can vary based on whether marking 308 was applied to stack 302 using mechanical indentation, invisible ink, color ink, magnetic ink, etc. Segment characteristic 322 can include a position 326 of mark segment 312 along edge 304. Position 326 of mark segment 312 may be defined as a distance between a fore-edge of media sheet 102 and a forward-most end of mark segment 312. Other segment characteristics 322 can be contemplated and controlled within the scope of this description.

Mark segments 312, which can be formed directly on edge 304 of media sheets 102, can vary across stack 302 as a function of thickness 316. More particularly, segment characteristics 322 of mark segments 312 can vary along mark axis 314 such that segment characteristics 322 of adjacent mark segments differ from each other. Accordingly, each mark segment 312 of mark 310 can have a unique segment characteristic 322, when compared to other mark segments 312 of mark 310. As such, mark segment 312 on edge 304 of a respective media sheet 102 can have segment characteristic 322 that encodes information about the respective media sheet 102.

In an embodiment, segment characteristic 322 can be specific to an attribute of the respective media sheet 102 on which the corresponding mark segment 312 is located. The respective media sheet 102 can have numerous attributes, such as a physical characteristic of media sheet 102, a location of media sheet 102 within stack 302, an authenticity of media sheet 102, or an identity of media sheet 102. Some of these attributes are described in more detail below. By way of example, however, segment characteristic 322 can encode information about the location of media sheet 102 within stack 302. In an embodiment, when mark 310 tapers in the downward direction, length 324 of each mark segment 312 can vary as a function of the location of media sheet 102 within stack 302. More particularly, mark segment 312 on top sheet 318 has a greatest length 324, and mark segment 312 on bottom sheet 320 has a smallest length 324. Thus, length 324 of each mark segment 312 encodes information about the level, or vertical location, of the respective media sheet 102 within stack 302.

Mark segments 312 can be applied to edge 304 of media segment, and thus, may be readable by an optical reader of printer 202 that images edge 304. Similarly, printer 202 can include an optical reader to image one or more faces 330 of media sheet 102. More particularly, each media sheet 102 can include a top face 330 and a bottom face joined at edge 304 along a perimeter of the sheet. Mark segments 312 along edge 304 of media sheet 102 can extend from edge 304 onto face 330. For example, a portion of mark segment 312 on face 330 can have a length 324 equal to a portion of mark segment 312 on edge 304. The portion on face 330 can be wider, however, than the portion on edge 304. That is, since the width of the portion on edge 304 is limited by a thickness of edge 304 (and the thickness can be 0.1 mm or less in the case of a paper sheet), the width of the portion on face 330 can be at least twice the thickness of the portion on edge 304. As such, segment characteristic 322 of mark segment 312 can be detected by an optical reader having a field of view that includes edge 304 and face 330.

Marks 310 of marking 308 can be applied to any sidewall 306 of stack 302, and thus, mark segments 312 may be on any edge 304 of media sheet 102. In an embodiment, one or more mark segments 312 can be on a fore-edge 304 of media sheet 102. Similarly, one or more mark segments 312 can be on an aft edge of media sheet 102. The fore-edge of media sheet 102 can be a leading-edge during a printing process, and the aft edge can be a trailing edge during the printing process. Accordingly, the optical reader of printer 202 can image mark segments 312 on the fore-edge or the aft edge to determine segment characteristics 322 corresponding to attributes of media sheet 102.

Figure 4:
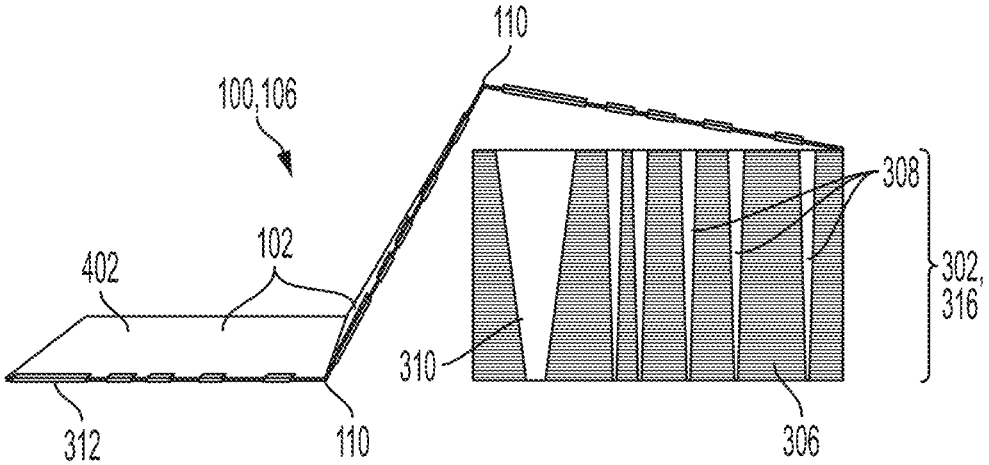
FIG. 4 is a side view of a media package having a continuous form, in accordance with some embodiments of the present disclosure.

Referring to FIG. 4, a side view of a media package having a continuous form is shown in accordance with an embodiment. Media package 100 having continuous form 106 includes a stack 302 of media sheets 102 that are portions of a continuous sheet 402. More particularly, continuous sheet 402 can have several folds 110 separating media sheets 102. Adjacent media sheets 102 can be joined along folds 110. A fore-edge of a first media sheet 102 can be fed through printer 202 and a second media sheet 102 can be pulled through printer 202 by the moving first media sheet 102. Accordingly, the media sheets 102 can be fed through the printer 202, and printed on, sequentially.

Media package 100 having continuous form 106 can include features similar or identical to those described above. For example, media package 100 can include marking 308 having one or more marks 310 on sidewall 306, as described above. Mark segments 312 can vary on media sheets 102 such that segment characteristics 322 of each mark segment 312 encodes information about the respective media sheet 102 having mark segment 312. Accordingly, mark segments 312 can be imaged by printer 202 as media sheets 102 are fed sequentially, and the information encoded on media sheets 102 can be read serially.

Figure 5:
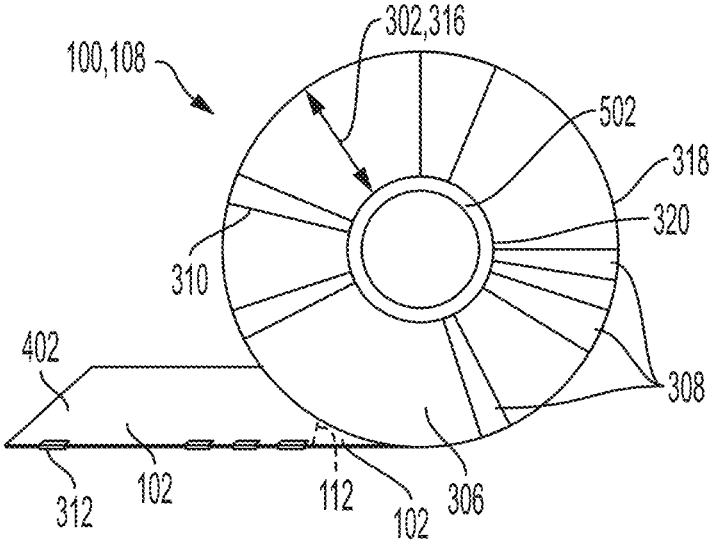
FIG. 5 is a side view of a media package having a roll form, in accordance with some embodiments of the present disclosure.

Referring to FIG. 5, a side view of a media package having a roll form is shown in accordance with an embodiment. Media package having roll form 108 includes a stack 302 of media sheets 102 mounted on a mounting core 502. Mounting core 502 can be a tube of material, such as a cardboard, plastic, or metal tube. Alternatively, mounting core 502 may be a solid rod of material. In an embodiment, continuous sheet 402 of printing media can be wound around mounting core 502 to form the roll. For example, continuous sheet 402 can include several media sheets 102 joined along respective reference joints 112, and media sheets 102 can be mounted on mounting core 502 to form media package 100 having an elliptical or circular profile. A fore-edge of a first media sheet 102 can be fed through printer 202 and a second media sheet 102 can be pulled through printer 202 by the moving first media sheet 102. Accordingly, the media sheets 102 can be fed sequentially through the printer 202, and printed on, sequentially.

Media package 100 having roll form 108 can include features similar or identical to those described above. For example, media package 100 can include marking 308 having one or more marks 310 on sidewall 306, as described above. Mark(s) 310 can extend radially. That is, thickness 316 of the roll can be defined radially between bottom sheet 320 in direct contact with mounting core 502 and top sheet 318. Mark(s) 310 can extend substantially across thickness 316, e.g., over at least half of thickness 316. Mark segments 312 can vary on media sheets 102 such that segment characteristics 322 of each mark segment 312 encodes information about the respective media sheet 102 having mark segment 312. Accordingly, mark segments 312 can be imaged by printer 202 as media sheets 102 are fed sequentially, and the information encoded on media sheets 102 can be read serially.

As described above, information about media sheets 102 can be encoded on edge 304 of stack 302 (which can be a roll form 108). The information can be detectable on individual sheets based on segment characteristics 322 that vary over thickness 316 of stack 302. For example, length 324, position 326, color, etc., of mark segments 312 can encode information about an attribute of media sheet 102 having the mark segment 312. The code for each segment can be a sheet-specific code. In addition, segment characteristics 322 can include relative characteristics of several mark segments 312 on edge 304. For example, a distance between a pair of mark segments 312 on edge 304 may encode information about the level of the media sheet 102 having the pair. Accordingly, information can be preserved in a serial readout of a mark segment pattern. The pattern can include combinations of segment lengths, segment colors, distances between segments, widths of segments on face(s) of media sheets, etc. Each detectable characteristic of mark segment 312 provides a bit of information that can be used to encode information about media sheet 102.

In an embodiment, mark segments 312 can encode sheet-level information. For example, length 324 of mark segment 312 can indicate a level of a corresponding media sheet 102 in stack 302. Similarly, marking 308 can encode batch-level information. For example, an overall pattern of marking 308 can indicate a media type of media sheets 102 in stack 302. Several variants of marking 308 on sidewall 306 of media package 100 are described below. It will be appreciated that the variants include patterns having features that can be combined in other variants not shown.

Figure 6:
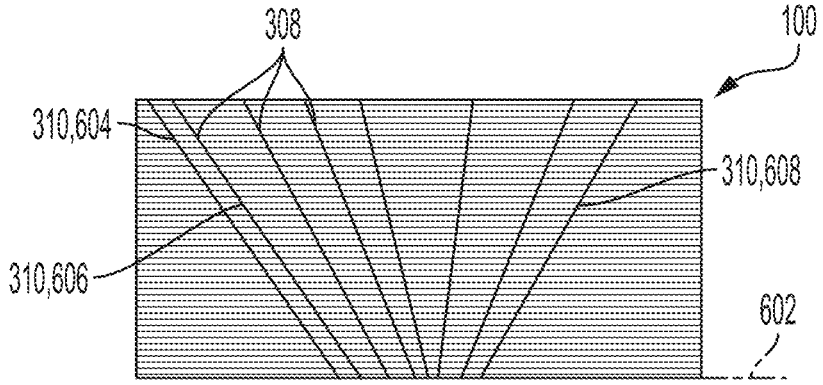
FIGS. 6-10 are side views of media packages having encoding variants, in accordance with some embodiments of the present disclosure.

Referring to FIG. 6, a side view of a media package having a first encoding variant is shown in accordance with an embodiment. Media package 100 can include marking 308 having several marks 310 extending in different directions relative to a horizontal plane 602. Horizontal plane 602 can be parallel to a top face or a bottom face of media package 100. In an embodiment, some or all of marks 310 vary in angular definition. For example, two or more marks 310 of marking 308 may extend in parallel directions. A first mark 604 can extend continuously in a first direction, and a second mark 606 can extend in the same direction offset from first mark 604 by the horizontal distance. By contrast, a third mark 608 of marking 308 can extend in another direction, which is not parallel to the first direction of first mark 604 and second mark 606. The parallel marks 310 of marking 308 can encode first information. For example, given that the horizontal distance between mark segments 312 of the parallel marks 310 will remain the same over the entire stack thickness, the distance can encode information about media package 100 that is constant, e.g., a media type of media sheets 102 in the package. By contrast, a distance between first mark 604 and third mark 608 will vary over the thickness of stack 302, and thus, the distance can encode second information. For example, the variable distance between first mark 604 and third mark 608 can encode information about a level of media sheet 102 within stack 302.

Figure 7:
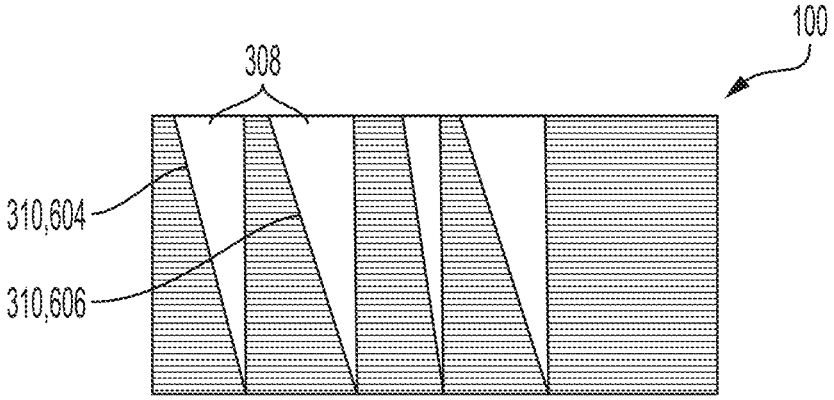

Referring to FIG. 7, a side view of a media package having a second encoding variant is shown in accordance with an embodiment. Media package 100 can include marking 308 having marks 310 that vary in width across media stack 302. Distances between locations on first mark 604 and locations on second mark 606 may be constant or variable. For example, a leading edge of first mark 604 may be parallel to a leading edge of second mark 606. Accordingly, the distance between the leading edges can be constant and can encode constant information about media package 100, such as a media type of media sheets 102. By contrast, a trailing edge of first mark 604 may not be parallel to the leading edge of second mark 606. Accordingly, the distance between the trailing edge of first mark 604 and the leading edge of second mark 606 can encode variable information about media package 100, such as a level of media sheet 102 within stack 302. As described above, lengths 324 of mark segments 312 vary across thickness 316, and accordingly, can encode additional variable information about media sheets 102 having the mark segments 312.

Figure 8:
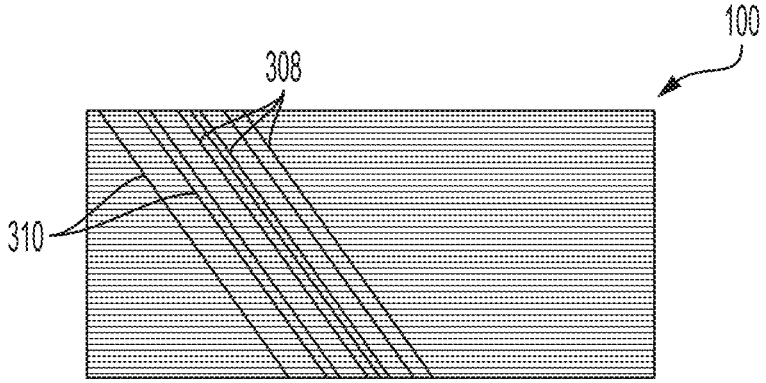

Referring to FIG. 8, a side view of a media package having a third encoding variant is shown in accordance with an embodiment. Media package 100 can include marking 308 having marks 310 that extend at a same angle over sidewall 306. More particularly, marks 310 may extend parallel to each other. Accordingly, mark segments 312 on each media sheet 102 can be separated from each other by a same distance. For example, a leftmost mark segment on each media sheet 102 can be separated from an adjacent mark segment by a same distance. Position 326 of the leftmost mark segment 312, however, may vary. For example, a first leftmost mark segment 312 on a first media sheet 102 may be nearer to a fore-edge of the first media sheet than a second leftmost mark segment on a second media sheet. Accordingly, the distance between the leftmost mark segment and an adjacent mark segment can be constant and can encode constant information about media package 100, such as a media type of media sheets 102. By contrast, position 326 of the leftmost mark segment can encode variable information about media package 100, such as a level of media sheet 102 within stack 302.

Figure 9:
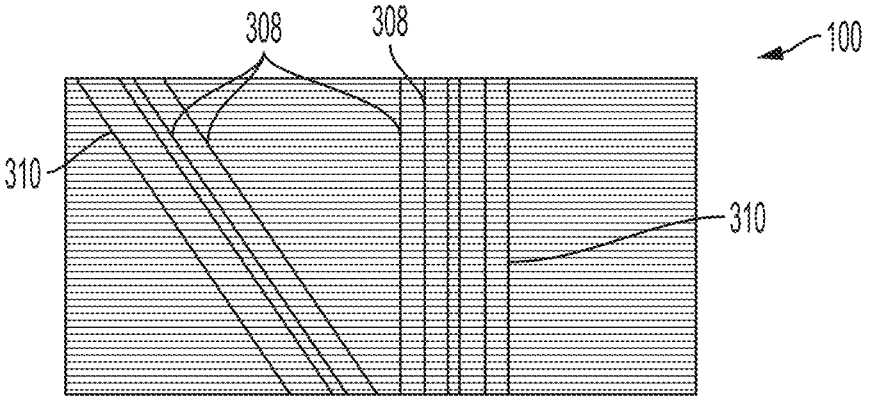

Referring to FIG. 9, a side view of a media package having a fourth encoding variant is shown in accordance with an embodiment. Marking 308 may be a mixed mode marking having some marks 310 at an angle on sidewall 306 and some marks 310 vertically on sidewall 306. As described above, constant characteristics about mark segments 312, such as a distance between the vertical mark segments 312, can encode constant information about media package 100. By contrast, segment characteristics 322 that vary along sidewall 306, such as a distance between mark segment 312 of an angled mark 310 and mark segment 312 of a vertical mark 310 can encode variable information about media package 100, such as a level of media sheet 102 within stack 302.

Figure 10:
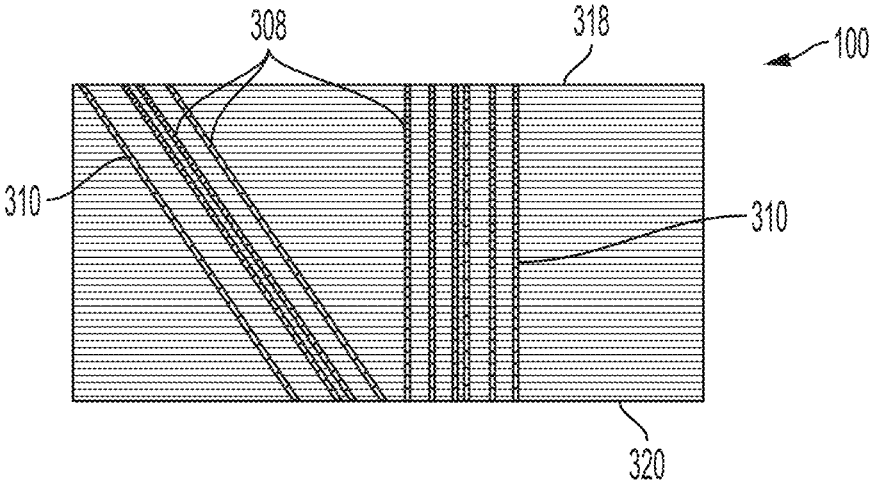

Referring to FIG. 10, a side view of a media package having a fifth encoding variant is shown in accordance with an embodiment. In addition to the segment characteristics described above, a color of each mark segment 312 on edge 304 can encode information about media package 100 and/or media sheet 102. More particularly, media information can be encoded in the color of one or more mark segments 312. For example, a leftmost mark 310 may be red, which may indicate information about media package 100, such as that media sheets 102 are of a particular weight paper. Another color may indicate different information. For example, a blue leftmost mark 310 can indicate that media sheets 102 are a different weight paper (than paper sheets encoded with the red leftmost mark 310).

Colors of mark segment 312 may vary across media stack 302 and the variation can encode information about media package 100 and/or media sheets 102. For example, an opacity of the leftmost line may vary over sidewall 306. In an embodiment, the opacity decreases from top sheet 318 toward bottom sheet 320 such that the line is lighter nearer to bottom sheet 320 than top sheet 318. The opacity can correspond to a density of the ink along marks 310. A value of the opacity of a mark segment 312 can encode a level of media sheet 102 having the mark segment in stack 302.

Figure 11:
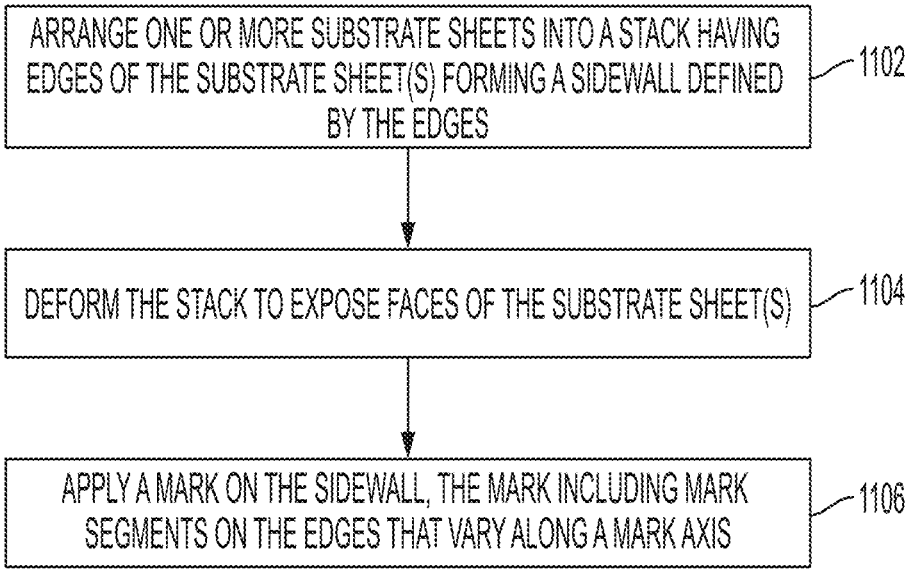
FIG. 11 is a flowchart of a method of fabricating a substrate package, in accordance with some embodiments of the present disclosure.

Referring to FIG. 11, a flowchart of a method of fabricating a substrate package, e.g., media package 100, is shown in accordance with an embodiment. Some operations of FIG. 11 are illustrated in FIGS. 12-15, and thus, FIGS. 11-15 are described in combination below. At operation 1102, one or more substrate sheets, e.g., media sheets 102, are arranged into stack 302. In an embodiment, media sheets 102 are stacked face-to-face to form media package 100 having individual form 104 or continuous form 106. For example, a continuous sheet 402 can be folded into stack 302 having continuous form 106. In another embodiment, stacking media sheets 102 can include winding or wrapping media sheets 102, which are portions of a continuous sheet 402, on mounting core 502 to form media package 100 having roll form 108.

Figure 12:
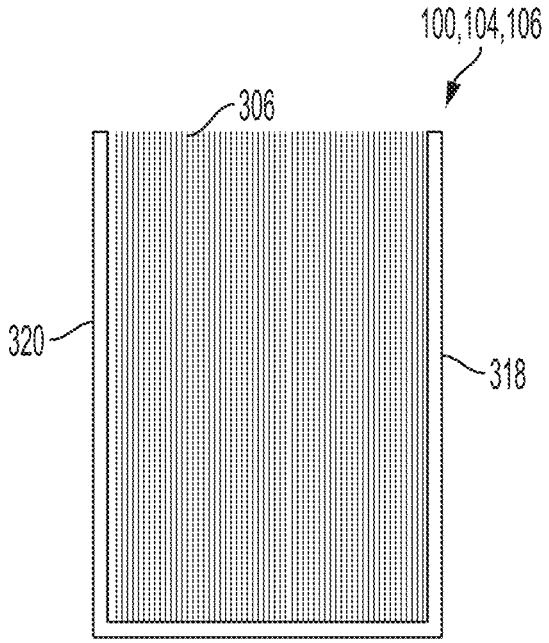
FIGS. 12-13 are side views of a substrate package being deformed to expose faces of substrate sheets in a substrate package having an individual form, in accordance with some embodiments of the present disclosure.

Referring to FIG. 12, a side view of an undeformed substrate package, e.g., media package 100, having an individual form is shown in accordance with an embodiment. When media package 100 has individual form 104 or continuous form 106, the side view of stack 302 approximates a rectangle. Media sheets 102 in the rectangle can be vertically oriented, and can have respective edges 304 that combine to define sidewall 306. Sidewall 306 can be marked, as described below, to apply marking 308 to edges 304 of media sheets 102.

Figure 13:
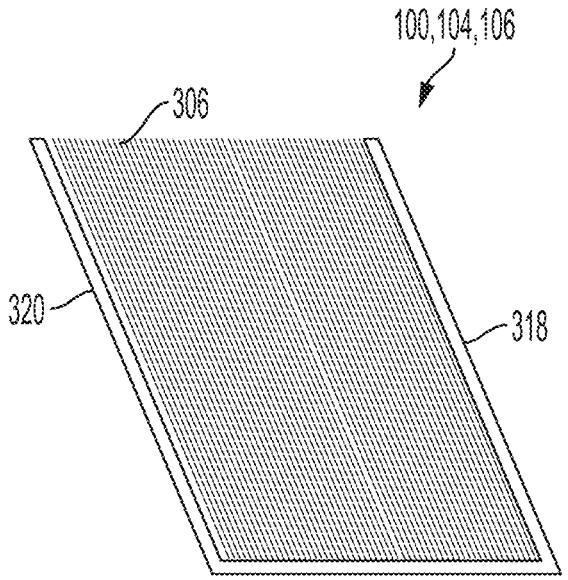

Referring to FIG. 13, a side view of a deformed substrate package, e.g., media package 100, having an individual form including media sheets having exposed faces is shown in accordance with an embodiment. Optionally, faces 330 of media sheets 102 can be exposed to allow marking 308 to be made across both edges 304 and faces 330 of media sheets 102. More particularly, mark segments 312 can extend from edge 304 to face 330 of media sheets 102. In an embodiment, at operation 1104, stack 302 can be deformed to expose faces 330 of the substrate sheet(s), e.g., media sheets 102. For example, stack 302 can be deformed by tilting sidewall 306 relative to one or more of top sheet 318 or bottom sheet 320. Whereas sidewall 306 can be perpendicular to top sheet 318 in the 1402 undeformed state, sidewall 306 can form an angle, e.g., an obtuse angle, with sidewall 306 in the deformed state. When media package 100 has individual form 104 or continuous form 106, the side view of stack 302 in the deformed state can approximate a parallelogram. Media sheets 102 in the parallelogram can be slanted such that each edge 304 is slightly retracted from edge 304 of an adjacent sheet. A portion of face 330 can be exposed between the adjacent edges 304. Accordingly, the tilted orientation can provide increased surface area for printing marking 308 on sidewall 306, e.g., edges 304 and/or faces 330 of media sheets 102. Mark 310 can be applied to the exposed faces 330, and the edges 304, as described below.

Figure 14:
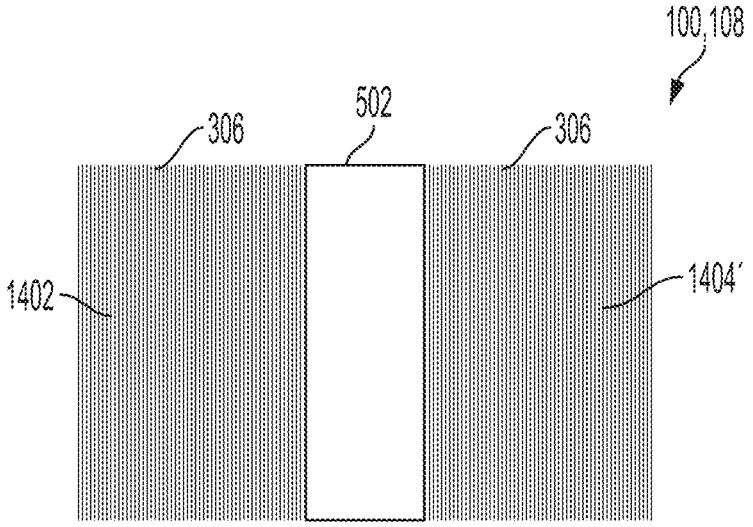
FIGS. 14-15 are side views of a substrate package being deformed to expose faces of substrate sheets in a substrate package a roll form, in accordance with some embodiments of the present disclosure.

Referring to FIG. 14, a side view of an undeformed substrate package having a roll form is shown in accordance with an embodiment. When media package 100 has roll form 108, profile of sidewall 306 can be flat. Accordingly, the side view of stack 302 can approximate a rectangle. More particularly, the media sheets 102 wound around mounting core 502 can form a first rectangular form on one side of mounting core 502 and a second rectangular form on another side of mounting core 502, when viewed in cross section. The cross sections of media sheets 102 in first form 1402 and second form 1404 can be vertically oriented, and can have respective edges 304 that combine to define sidewall 306. Sidewall 306, when viewed from above, can have an annular profile, with mounting core 502 forming a central lumen of the annulus. Sidewall 306 can be marked, as described below, to apply marking 308 to edges 304 of media sheets 102.

Figure 15:
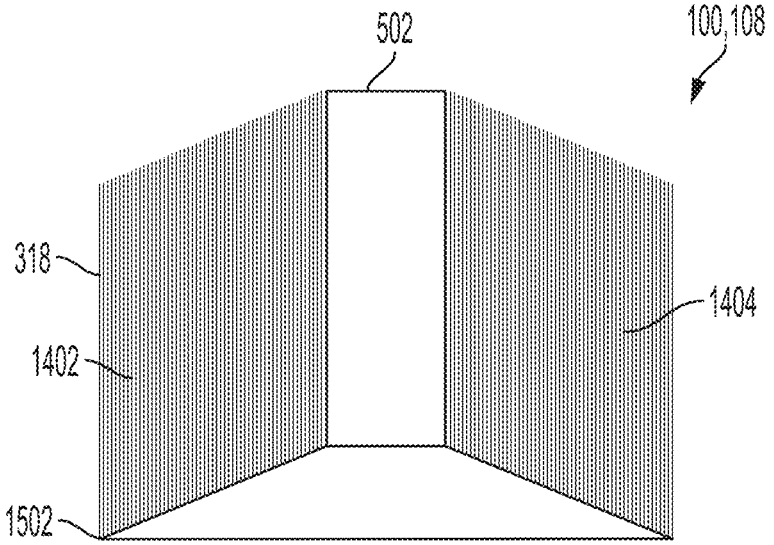

Referring to FIG. 15, a side view of a deformed substrate package having a roll form including media sheets having exposed faces is shown in accordance with an embodiment. Optionally, faces 330 of media sheets 102 can be exposed to allow marking 308 to be made across both edges 304 and faces 330 of media sheets 102. More particularly, mark segments 312 can extend from edge 304 to face 330 of media sheets 102. In an embodiment, stack 302 is deformed by moving mounting core 502 relative to top sheet 318. For example, mounting core 502 can be moved vertically relative to a bottom edge 1502 of top sheet 318. By moving mounting core 502 and keeping top sheet 318 stationary, media sheets 102 can slide over each other. When media package 100 has roll form 108, the deformed media sheets 102 can have a cross section in first form 1402 and second form 1404 that does not have a flat profile. For example, the profile of sidewall 306 can be curved or conical. As shown in FIG. 15, the profile can be frustoconical, having a flat area over mounting core 502 and slanted areas over first form 1302 and second form 1404. As illustrated, the first form 1402 and second form 1404 can approximate a parallelogram in the deformed state. Media sheets 102 in the parallelogram can be slanted such that each edge 304 is slightly retracted from edge 304 of an adjacent sheet. Accordingly, a portion of face 330 is exposed between the adjacent edges 304. Mark 310 can be applied to the exposed faces 330 on the tapered sidewall 306 of the deformed roll.

At operation 1106, mark 310 can be applied on sidewall 306. As described above, mark 310 can include mark segments 312 on edges 304 that vary along mark axis 314. For example, segment characteristics 322 of mark segments 312 can vary along mark axis 314 such that mark segment 312 on edge 304 of media sheet 102 has segment characteristic 322 specific to an attribute of media sheet 102. The marks 310 can be continuous, and thus, applying mark 310 on sidewall 306 can include applying marking 308 having several continuous marks 310 on sidewall 306 in a single imprinting operation.

Mark 310 can be applied to sidewall 306 using numerous techniques. For example, marks 310 can be applied to sidewall 306 using additive techniques that apply a marking material on edges 304 or faces 330 of media sheets 102. In an embodiment, the marking material is printed on sidewall 306. For example, marks 310 can be inkjet printed, laser printed, aerosol printed, or screen printed onto sidewall 306. Various ink types can be used to print marks 310. For example, mark 310 can be printed with a visible ink. Mark 310 may, however, be printed with inks that are invisible to the human eye. For example, the printing ink may be an infrared ink that fluoresces under infrared light. Although a human may not see the infrared fluorescence, it may be detected by the optical reader of printer 202. Similarly, the marking material can be a luminescent ink. Luminescent inks can allow a contrast of the emissive marking 308 to be brighter and more recognizable by the optical reader of printer 202. That is, luminescent inks may be more easily detectable by the optical reader than inks containing non-luminescent pigments or dyes. In an embodiment, ink can be a phosphorescent ink or a fluorescent ink that emits a certain wavelength when excited by an input wavelength. In such case, optical reader of printer 202 can emit the excitation wavelength from a photodiode and capture images of the emitted wavelength with a camera. Similarly, ink may be a thermochromic ink that changes color based on a temperature of the ink. In such case, printer 202 may include a component, e.g., an infrared heater, that increases a temperature of the thermochromic ink during the printing process. The optical reader of printer 202 can then identify the mark segment color to read the encoded information. Additive markings 308 can also include printing or otherwise applying magnetic inks. Magnetic markings 308 can be read by an electromagnetic pickup head of the printer 202. Similarly, capacitive markings 308, e.g., metallic markings, can be applied to edges 304 and faces 330 of media sheets 102 to be sensed by a capacitive sensor of printer 202. More particularly, conductive or capacitive markings 308 may be read by measuring contact current, induced currents, eddy currents, or by measuring capacitance.

Mark 310 can be applied to sidewall 306 using subtractive techniques. In an embodiment, marks 310 can be stamped on sidewall 306. For example, mark segments 312 can include indentations on edges 304 or faces 330 of media sheets 102. The mechanical indentations can be made on edges 304 and/or faces 330 by a stamping tool. Indentations can be formed using other techniques, such as ablation or laser marking techniques. In an embodiment, indentations can be formed by removing a portion of media sheets 102. For example, media sheets 102 can be chemically altered using etching techniques. Mechanical markings 308, such as indentations, can be read by an electrometrical, piezoelectric, or microelectromechanical sensor of printer 202.

Marks 310 and mark segments 312, which are applied directly on edge 304 or face 330 of stacked media as described above, can encode a wide range of information about media package 100 and media sheets 102 to allow printer 202 to detect information about the media or about a printing process that is used to print on the media. Markings 308 can encode information to allow printer 202 to detect media usage, e.g., how much of media package 100 has been used in the stack 302. Media usage can be determined based on a level of the media sheet 102 being printed. For example, when the media sheet 102 is at the center level of stack 302, printer 202 can determine that half of stack 302 has been used (and half of stack 302 remains). The level can be determined based on segment characteristics 322, as described above. In an embodiment, printer 202 can determine the level of media sheets 102 based on a distance between mark segments 312. For example, in the case of media package 100 having roll form 108, marks 310 can be radial marks that radiate from mounting core 502 toward top sheet 318. A distance between mark segments of adjacent marks 310 will vary across the radius of the roll based on an arc length between radial lines at different radii. More particularly, a distance between mark segments on top sheet 318 will be greater than a distance between mark segments on bottom sheet 320. Accordingly, as media sheets 102 of the roll are fed through printer 202, the frequency that mark segments are detected will increase, i.e., less time will pass between detection of a first and second mark segment. The detection frequency can be used by printer 202 to determine the level of media sheet 102 in stack 302.

Markings 308 can encode information to allow printer 202 to detect media type, e.g., paper type, paper coating type, paper weight, or paper finish of media sheets 102. Markings 308 can encode information to allow printer 202 to detect calibration information. For example, printer 202 can set a printing parameter, such as a printing speed, based on information derived from markings 308. In short, printer 202 can detect information encoded in mark segments 312 on media sheets 102 that can be used by printer 202 to control the process of printing on media sheets 102.

Mark segments 312 can be detected to determine an authenticity of media sheets 102 or a product, e.g., a book, manufactured using media sheets 102. For example, mark segments 312 can act as a barcode printed on edges 304 of media sheets 102. When media sheets 102 are compiled into the book, the barcode can be visible to a scanner. Accordingly, mark segments 312 on an individual media sheet 102 can provide a barcode that acts as a watermark or a unique identifier of media sheet 102 or a source of media sheet 102. Similarly, the printed edges of the book pages can be scanned to read the barcode and detect that the book has come from a particular source. Accordingly, printer 202 can be configured to print media sheets 102 only when media sheets 102 contain the unique identifier from the expected source.

In an embodiment, marking 308, marks 310, or mark segments 312 encode information about a product containing media sheets 102. For example, when media sheets 102 that have been imprinted with mark segments 312 are compiled into a book, the mark segments may encode information about the book. By way of example, the mark segments 312 can provide a two-dimensional scannable code that can be read by a scanner to determine an author of the book, a number of pages of the book, a publisher of the book, etc. Similarly, appliances manufactured using substrate sheets that have printed edges 304 can have the edges read by a scanner to determine a manufacturer, model, etc., of the appliance.

In an embodiment, printer 202 can use information derived from mark segments 312 to detect double fed paper. Ream feed printers, e.g., printers configured to print media packages 100 having individual form 104, feed and print on paper sheets sequentially. Occasionally, a first media sheet and a second media sheet may be fed concurrently, e.g., nearly simultaneously. More particularly, the first media sheet can be fed into the printing path and the second media sheet can be fed alongside the first media sheet such that the media sheets 102 overlap at least partially. For example, most double feeds include the first media sheet and the second media sheet exactly double fed (exactly overlapped) or offset from each other by a small amount, e.g., several millimeters.

Overlapping mark segments 312 can indicate a double feed. For example, if the first media sheet and the second media sheet are paper sheets having a thickness of 0.1 millimeter, and mark 310 having length 324 of 1 millimeter is printed at 45 degrees on edges 304 of the media sheets 102, then printer 202 would detect both mark segments 312 as the double fed paper passes through the field of view of the optical reader. More particularly, the mark segments of the first media sheet and the second media sheet would appear as a unitary mark segment 312 having length 324 of 1.1 millimeters. If the sheets are offset slightly, e.g., by 0.5 millimeters, then the mark segments of the first media sheet and the second media sheet would appear as a unitary mark segment 312 having length 324 of 1.6 millimeters. Printer 202 can determine, based on the unitary mark segment 312 having a length 324 that is greater than an expected length, that a double-feed has occurred. Printer 202 can then take appropriate corrective measures. Printer 202 may be able to operate at higher speeds by detecting double-feeds based on optical identification of mark segments than existing printers are able to operate using existing double-feed detection techniques.

Various operations are described as multiple discrete operations, in turn, in a manner that is most helpful in understanding the present disclosure, however, the order of description may not be construed to imply that these operations are necessarily order dependent. In particular, these operations need not be performed in the order of presentation.

The preceding description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular embodiments may vary from these exemplary details and still be contemplated to be within the scope of the present disclosure.

Additionally, some embodiments may be practiced in distributed computing environments where a machine-readable medium is stored on and or executed by more than one computer system. In addition, the information transferred between computer systems may either be pulled or pushed across the communication medium connecting the computer systems.

Embodiments of the claimed subject matter include, but are not limited to, various operations described herein. These operations may be performed by hardware components, software, firmware, or a combination thereof.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such. Furthermore, the terms "first," "second," "third," "fourth," etc. as used herein are meant as labels to distinguish among different elements and may not necessarily have an ordinal meaning according to their numerical designation.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims. The claims may encompass embodiments in hardware, software, or a combination thereof.

What is claimed is:

1. A substrate package, comprising:

one or more substrate sheets arranged in a stack, wherein the stack has a sidewall defined by edges of the one or more substrate sheets; and a mark on the sidewall, wherein the mark includes a plurality of mark segments on the edges and along a mark axis, wherein the mark varies along the mark axis, and wherein segment characteristics of the plurality of mark segments vary along the mark axis such that a mark segment on an edge of a substrate sheet has a segment characteristic specific to an attribute of the substrate sheet, wherein the one or more substrate sheets have respective faces, and wherein the plurality of mark segments extend from the edges onto the faces.

2. The substrate package of claim 1 further comprising a marking on the sidewall, wherein the marking is a variable marking applied to the sidewall in a single marking operation.

3. The substrate package of claim 2, wherein the variable marking has a plurality of continuous marks including the mark.

4. The substrate package of claim 1, wherein the sidewall has a thickness between a top sheet and a bottom sheet of the stack, and wherein the mark extends along at least half of the thickness.

5. The substrate package of claim 1, wherein the segment characteristic include one or more of a length of the mark segment, a color of the mark segment, or a position of the mark segment along the edge.

6. The substrate package of claim 1, wherein the attribute includes one or more of a physical characteristic of the substrate sheet, a location of the substrate sheet within the stack, an authenticity of the substrate sheet, or an identity of the substrate sheet.

7. The substrate package of claim 1, wherein the plurality of mark segments include a marking material on the edges.

8. The substrate package of claim 7, wherein the marking material is one or more of a luminescent ink, a phosphorescent ink, or a thermochromic ink.

9. The substrate package of claim 1, wherein the one or more substrate sheets include paper sheets.

10. The substrate package of claim 1 further comprising a mounting core, wherein the one or more substrate sheets are portions of a continuous sheet mounted on the mounting core.

11. The substrate package of claim 10, wherein the continuous sheet is wound on the mounting core, and wherein the continuous sheet includes one or more of a plastic foil, a metal foil, a film, a fabric, or a membrane.

12. The substrate package of claim 1, wherein the one or more substrate sheets are portions of a continuous sheet having a plurality of folds separating the one or more substrate sheets.

13. The substrate package of claim 12, wherein the continuous sheet is folded into the stack, and wherein the continuous sheet includes one or more of a plastic foil, a metal foil, a film, a fabric, a paper sheet, or a membrane.

14. The substrate package of claim 1, wherein the one or more substrate sheets include one or more of a tile sheet, a wood sheet, a metal sheet, a glass sheet, or a plastic sheet.

15. A substrate package, comprising:

one or more substrate sheets arranged in a stack, wherein the stack has a sidewall defined by edges of the one or more substrate sheets; and a mark on the sidewall, wherein the mark includes a plurality of mark segments on the edges and along a mark axis, wherein the mark varies along the mark axis, and wherein segment characteristics of the plurality of mark segments vary along the mark axis such that a mark segment on an edge of a substrate sheet has a segment characteristic specific to an attribute of the substrate sheet, wherein the plurality of mark segments include an indentation in the edges.

16. A method, comprising:

arranging one or more substrate sheets into a stack having edges of the one or more substrate sheets forming a sidewall defined by the edges;

applying a mark on the sidewall, wherein the mark includes a plurality of mark segments on the edges and along a mark axis, wherein the mark varies along the mark axis, and wherein segment characteristics of the plurality of mark segments vary along the mark axis such that a mark segment on an edge of a substrate sheet has a segment characteristic specific to an attribute of the substrate sheet;

deforming the stack to expose faces of the one or more substrate sheets; and applying the mark on the exposed faces.

17. The method of claim 16, wherein deforming the stack includes tilting the sidewall relative to one or more of a top sheet or a bottom sheet of the stack.

18. The method of claim 16, wherein stacking the one or more substrate sheets includes wrapping the one or more substrate sheets on a mounting core such that a profile of the sidewall is flat, and wherein deforming the stack includes moving the mounting core relative to a top sheet of the stack such that the profile is curved.

19. The method of claim 16, wherein applying the mark includes applying, on the sidewall, a marking having a plurality of continuous marks including the mark.

* * * * *